US009530603B1

(12) United States Patent
Kobayashi

(10) Patent No.: US 9,530,603 B1
(45) Date of Patent: Dec. 27, 2016

(54) FLAT EMITTER

(71) Applicant: Shimadzu Corporation, Kyoto (JP)

(72) Inventor: Takumi Kobayashi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 14/922,241

(22) Filed: Oct. 26, 2015

(51) Int. Cl.
*H01J 9/02* (2006.01)
*H01J 1/16* (2006.01)
*H01J 35/06* (2006.01)

(52) U.S. Cl.
CPC . *H01J 1/16* (2013.01); *H01J 35/06* (2013.01)

(58) Field of Classification Search
CPC ..... H01J 1/16; H01J 1/15; H01J 35/06
USPC ..... 313/319, 341
See application file for complete search history.

(56) References Cited

FOREIGN PATENT DOCUMENTS

JP 2012-015045 A 1/2012

*Primary Examiner* — Vip Patel
(74) *Attorney, Agent, or Firm* — Renner, Otto, Boisselle & Sklar, LLP

(57) ABSTRACT

A flat emitter comprises four current-supply heating legs. Half lighting for a small focus in which a current is supplied to heat only a region narrower and full lighting for a large focus in which a current is supplied to heat the entire region are selectable according to the combination of the legs. Either one of a set of the two full-lighting current-supply heating legs for the full lighting and a set of the two half-lighting current-supply heating legs for the half lighting is linearly formed, and the other is formed to be bent plural times in zigzag to set the space between the full-lighting current-supply heating leg and the half-lighting current-supply heating leg, which are adjacent to each other, at their terminals to be larger than the space at their base parts.

6 Claims, 15 Drawing Sheets

FLAT EMITTER

BACKGROUND OF THE INVENTION

1. Field of the Invention

The present invention relates to a flat emitter used for an electron source for an X-ray tube or for an electron source for another use, and more particularly to a technique of controlling lighting with four current-supply heating legs.

2. Description of the Related Art

An X-ray apparatus using an X-ray tube reduces a focal size of electrons upon X-raying or photographing a microscopic area, and enlarges a focal size upon X-raying or photographing a subject having a large body thickness in order to reduce a load to an anode. A structure is considered in which a plurality of emitters (also referred to as "filaments") is prepared and each emitter is switched according to a purpose. However, preparing a plurality of emitters according to a purpose makes the structure complicated, and also increases the structure of the X-ray tube.

In view of this, a single flat emitter that can form a plurality of focal spots with different sizes has recently been proposed by the applicant of the present application (For example, see Japanese Unexamined Patent Publication No. 2012-15045). This flat emitter is referred to as a "flat double emitter" below. A structure of a conventional flat emitter including a conventional flat double emitter will be described with reference to FIGS. 7 to 15. FIG. 7 is a schematic plan view of a conventional flat emitter, FIG. 8 is a schematic plan view of a conventional flat double emitter, FIG. 9 is a diagram schematically illustrating an arrangement relation between a focusing electrode and an emitter, FIG. 10 is a schematic view of the conventional flat emitter in which the current-supply heating leg illustrated in FIG. 7 is folded at 90 degrees from its base part, FIG. 11 is a schematic view illustrating that the conventional flat emitter illustrated in FIG. 10 is assembled to a base for an X-ray tube, FIG. 12 is a schematic view illustrating a flat double emitter (double emitter of type 1) in which the current-supply heating leg illustrated in FIG. 8 is folded at 90 degrees from its base part, FIG. 13 is a schematic view illustrating that the flat double emitter (double emitter of type 1) illustrated in FIG. 12 is assembled to a base for an X-ray tube, FIG. 14 is a schematic view illustrating a flat double emitter (double emitter of type 2) in which all of current-supply heating legs are bent plural times in zigzag, and FIG. 15 is a schematic view illustrating that the flat double emitter (double emitter of type 2) as illustrated in FIG. 14 is assembled to abase for an X-ray tube.

As illustrated in FIG. 7, a conventional flat emitter has two current-supply heating legs 102 and 103 at a base part of an electron emission surface 101. An electric current is supplied from the legs 102 and 103 to heat the entire region of the electron emission surface 101 as indicated by a hatched area with positive slope in the figure, whereby thermoelectrons are emitted from the entire region of the electron emission surface 101. The thermoelectrons B (see FIG. 9) emitted from the electron emission surface 101 collide against a target T including an anode, which results in the generation of an X-ray R (see FIG. 9). The structure in FIG. 7 provides only one type of a focal spot.

In view of this, a flat double emitter illustrated in FIG. 8 is configured to form two sizes of focal spots with a single emitter. As illustrated in FIG. 8, this flat double emitter includes four current-supply heating legs 102 to 105 at the base part of an electron emission surface 101. The legs 102 and 103 out of the legs 102 to 105 are full-lighting current-supply heating legs 102 and 103 used for full lighting for a large focus in which a current is supplied to heat the entire region of the electron emission surface 101 (hereinafter referred to as "full lighting") to emit electrons. On the other hand, the legs 104 and 105 out of the legs 102 to 105 are half-lighting current-supply heating legs 104 and 105 used for half lighting for a small focus in which a current is supplied to heat only a region narrower than the entire region of the electron emission surface 101 (hereinafter referred to as "half lighting") to emit electrons.

Specifically, when the entire region (see a hatched area with positive slope in the figure) of the electron emission surface 101 is to be heated as illustrated in FIG. 8A, a current is supplied from the full-lighting current-supply heating legs 102 and 103 (see the hatched area with positive slope in the figure) to heat the entire surface. On the other hand, when the electron emission surface is locally lighted to restrict the electron emission range for reducing a focal spot, a current is supplied from the half-lighting current-supply heating legs 104 and 105 (see the hatched area with positive slope in the figure) to light and heat only the hatched area with positive slope in the figure as illustrated in FIG. 8B. In the full lighting, the current supply path becomes the full-lighting current-supply heating leg 102→the base part of the full-lighting current-supply heating leg 102→the base part of the half-lighting current-supply heating leg 105→the base part of the half-lighting current-supply heating leg 104→the base part of the full-lighting current-supply heating leg 103→the full-lighting current-supply heating leg 103. In the half lighting, the current supply path becomes the half-lighting current-supply heating leg 104→the base part of the half-lighting current-supply heating leg 104→the base part of the half-lighting current-supply heating leg 105→the half-lighting current-supply heating leg 105. In this way, the current supply path is changed to switch the electron emission region.

When an emitter is used as an X-ray electron source, a focusing electrode C is disposed on the front surface (emission surface) of the emitter E for focusing thermoelectrons B on a target T composed of an anode as illustrated in FIG. 9. If the flat emitter including the legs for the current supply and heating has a plate-like shape as illustrated in FIG. 7 or 8, there arise problems such that (1) a complicated mechanism is required to dispose the emitter relative to the electrode, and further, the work for disposing the emitter becomes complicated, and (2) the electron emission region (see the thermoelectrons B in FIG. 9) spreads to the legs upon an irradiation of high current, which fails to form a desired focal spot shape.

In view of this, in the conventional flat emitter illustrated in FIG. 7, the current-supply heating legs 102 and 103 are folded from their base parts at 90 degrees as illustrated in FIG. 10 so as to allow only the necessary electron emission region to face the electrode. The legs 102 and 103 are folded at 90 degrees at portions indicated by a broken line in FIG. 7 to place them to be opposite to each other as illustrated in FIG. 10. FIG. 10A is a schematic perspective view of the conventional flat emitter, FIG. 10B is a schematic front view viewed from front F in FIG. 10A, FIG. 10C is a schematic side view viewed from a side face S in FIG. 10A, and FIG. 10D is a schematic plan view viewed from a top surface U in FIG. 10A.

When the emitter is assembled to an X-ray tube, the emitter is generally assembled as illustrated in FIG. 11 for simplifying an assembling process to the X-ray tube. Specifically, terminals of the current-supply heating legs 102 and 103 are fixed to electrode bars ER (an insulating member such as a ceramic and an electrode bar are collectively referred to as a "base" below) brazed to an insulating member I such as a ceramic with brazing or welding, and then, the legs 102 and 103 are assembled to an X-ray tube.

For the reason described above, in the conventional flat double emitter illustrated in FIG. 8, four current-supply heating legs 102 to 105 are folded from their base parts at 90 degrees as illustrated in FIG. 12, as in the conventional flat emitter. The legs 102 to 105 are folded at portions indicated by a broken line in FIG. 8 at 90 degrees, and the four legs 102 to 105 are placed such that the full-lighting current-supply heating legs 102 and 103 are opposite to each other as symmetric about a center axis, which is a vertical axis of the electron emission surface 101 and passes through the center of the electron emission surface 101, and the half-lighting current-supply heating legs 104 and 105 are opposite to each other as symmetric about the center axis, as illustrated in FIG. 12. The flat double emitter in which the legs 102 to 105 are linearly formed as illustrated in FIG. 12 is referred to as a "double emitter type 1" below. FIG. 12A is a schematic perspective view of the double emitter type 1, FIG. 12B is a schematic front view viewed from front F in FIG. 12A, FIG. 12C is a schematic side view viewed from a side face S in FIG. 12A, and FIG. 12D is a schematic plan view viewed from a top surface U in FIG. 12A.

In order to assemble the double emitter type 1 to an X-ray tube, terminals of the four current-supply heating legs 102 to 105 are fixed to the electrode bars ER (base) brazed to the insulating member I with welding as illustrated in FIG. 13. FIG. 13A is a schematic perspective view illustrating that the double emitter type 1 is assembled to the base for the X-ray tube, and FIG. 13B is a schematic plan view viewed from the bottom surface in FIG. 13A.

However, the structure of the double emitter type 1 has a problem of very small space between the electrode bars ER of the base as apparent from FIG. 13. Therefore, it is extremely difficult to fix the electrode bars ER to the insulating member such as a ceramic while providing electrical insulation between the electrode bars ER. It is considered that the electrode bar ER is made thin. However, this is not preferable from the viewpoint of strength.

In view of this, the structure described below is considered for surely providing insulation between the electrode bars ER. Specifically, as illustrated in FIG. 14, the four current-supply heating legs 102 to 105 are folded from their base parts at 90 degrees, and all current-supply heating legs 102 to 105 are bent plural times (twice in FIG. 14) in zigzag to widen the terminals of the legs 102 to 105. The flat double emitter in which all legs 102 to 105 are bent plural times in zigzag as illustrated in FIG. 14 is referred to as a "double emitter type 2" below. FIG. 14A is a schematic perspective view of the double emitter type 2, FIG. 14B is a schematic front view viewed from front F in FIG. 14A, FIG. 14C is a schematic side view viewed from a side face S in FIG. 14A, and FIG. 14D is a schematic plan view viewed from a top surface U in FIG. 14A.

In FIG. 14, the legs 102 to 105 are bent at right angle (90 degrees), and then, further bent at right angle (90 degrees) in zigzag. Thus, the legs 102 to 105 are bent twice in zigzag. The number of bending the legs in zigzag is not limited to two in FIG. 14. The number may be two or more. As described above, the legs 102 to 105 are bent plural times in zigzag, whereby the directions in which the legs 102 to 105 extend at their terminals can be aligned parallel to one another.

In order to assemble the double emitter type 2 to an X-ray tube, terminals of the four current-supply heating legs 102 to 105 are fixed to the electrode bars ER (base) brazed to the insulating member I with welding as illustrated in FIG. 15. In the structure of the double emitter type 2, the space between the electrode bars ER of the base is large as apparent from FIG. 15, which makes it easy to fix the electrode bars ER while providing electrical insulation between the electrode bars ER.

However, in the double emitter type 2, all legs are long, and have a zigzag shape. Therefore, keeping balance is difficult, and the legs are difficult to be fixed to the base with high precision. Accordingly, there arise the problems described below.

(1) The electron emission surface is deformed due to unnatural stress caused by the fixation, which fails to form a desired focal spot shape.

(2) The deformation in the above (1) causes positional deviation in the double emitter type 2, which makes it difficult to dispose the double emitter type 2 relative to the focusing electrode C (see FIG. 9) with high precision. If the double emitter type 2 cannot be disposed with high precision, the focal spot might be enlarged or asymmetry might occur, entailing a problem in which a desired focal spot shape cannot be obtained.

The present invention is accomplished in view of the above circumstances, and aims to provide a flat emitter that is easily assembled to an electron source for an X-ray tube or an electron source for another use and has a shape capable of attaining high positional precision.

SUMMARY OF THE INVENTION

A flat emitter used for an electron source, the flat emitter comprises: four current-supply heating legs; wherein half lighting for a small focus in which a current is supplied to heat only a region narrower than an entire region to emit electrons and full lighting for a large focus in which a current is supplied to heat the entire region to emit electrons are selectable according to the combination of the legs, all of the four current-supply heating legs are folded at a base part of an electron emission portion, and either one of a set of the two full-lighting current-supply heating legs for the full lighting and a set of the two half-lighting current-supply heating legs for the half lighting is linearly formed, and the other is formed to be bent plural times in zigzag to set the space between the full-lighting current-supply heating leg and the half-lighting current-supply heating leg, which are adjacent to each other, at their terminals to be larger than the space at their base parts.

According to the flat emitter, the space between the full-lighting current-supply heating leg and the half-lighting current-supply heating leg, which are adjacent to each other, at their terminals can be made larger than the space at their base parts, whereby the distance between the electrode bars for fixing the legs is increased, and electrical insulation between the bars is easily provided. Either one of the sets of the legs is linearly formed, whereby the balance of the flat emitter can easily be kept when the flat emitter is assembled to an electron source. Accordingly, the deformation of the electron emission surface is difficult to occur.

Preferably the two full-lighting current-supply heating legs are linearly formed, and the two half-lighting current-supply heating legs are bent plural times in zigzag.

According to this configuration, the temperature distribution in the electron emission surface becomes almost uniform.

Preferably the two full-lighting current-supply heating legs or the two half-lighting current-supply heating legs linearly formed are disposed to be symmetric with each other about a plane which is in the vertical direction of an electron emission surface, in the direction parallel to a folding line at the base part, and passes through the center of the electron emission surface.

According to this configuration, the balance of the flat emitter can easily be kept when the flat emitter is assembled to an electron source. Accordingly, the deformation of the electron emission surface is difficult to occur.

Preferably the two half-lighting current-supply heating legs or the two full-lighting current-supply heating legs bent plural times in zigzag are disposed to be symmetric with each other about a center axis that is a vertical axis of an electron emission surface and passes through the center of the electron emission surface.

According to this configuration, the flat emitter can easily be assembled to an electron source for an X-ray tube or an electron source for another use with high precision.

Preferably the full-lighting current-supply heating legs and the half lighting current-supply heating legs have the same height in the direction vertical to an electron emission surface.

The height of the electrode bars on the base for fixing the legs can be the same, whereby the electron emission surface can be fixed on a horizontal plane.

Preferably when the flat emitter is projected on a plane formed by dropping folding lines at the base part as perpendicular lines, the pair of the full-lighting current-supply heating leg and the half-lighting current-supply heating leg folded at the same folding line is disposed to be overlapped with each other on the plane on which the flat emitter is projected.

According to this configuration, strength can be increased when the legs are fixed to the base used to assemble the flat emitter to an electron source for an X-ray tube or an electron source for another use. In addition, the legs can be fixed with high precision.

According to the flat emitter of the present invention, either one of a set of two full-lighting current-supply heating legs for full lighting and a set of two half-lighting current-supply heating legs for half lighting is linearly formed, and the other is bent plural times in zigzag. With this configuration, the space between the full-lighting current-supply heating leg and the half-lighting current-supply heating leg, which are adjacent to each other, at their terminals can be made larger than the space at their base parts. In addition, the balance of the flat emitter can easily be kept, and deformation is difficult to occur.

DETAILED DESCRIPTION OF PREFERRED EMBODIMENTS

Hereinafter, preferred embodiments of the present invention will be described with reference to the drawings.

Figure 1A:
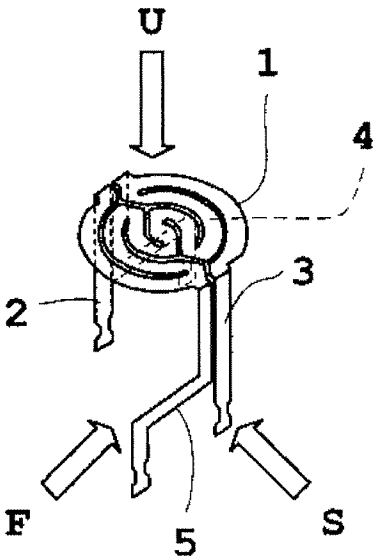
FIGS. 1A to 1D are each a schematic diagram illustrating a flat double emitter (double emitter type 3) according to an embodiment in which half-lighting current-supply heating legs are bent twice in zigzag.
Figure 1B:
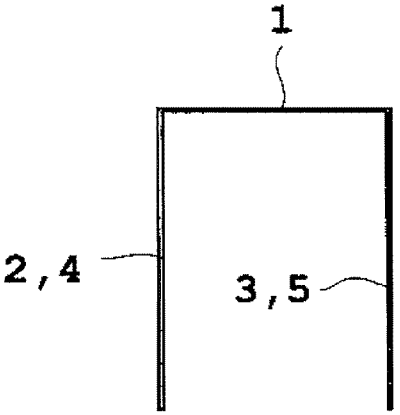
Figure 1C:
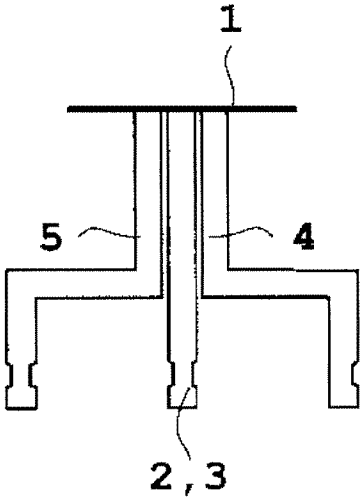
Figure 1D:
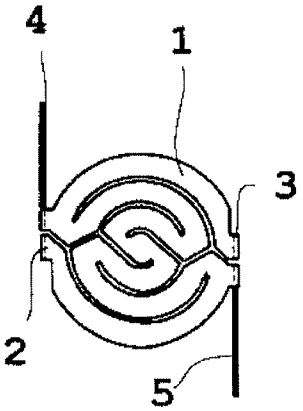
Figure 2:
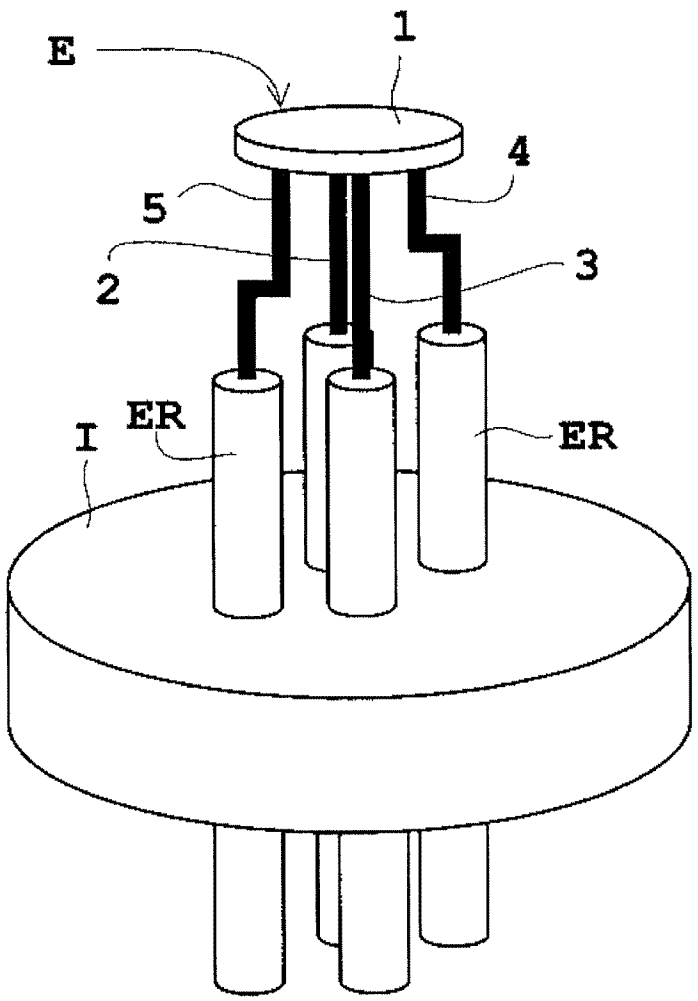
FIG. 2 is a schematic view illustrating that the flat double emitter (double emitter type 3) in FIG. 1 is assembled to a base for an X-ray tube.

FIG. 1 is a schematic diagram illustrating a flat double emitter (double emitter type 3) according to an embodiment in which half-lighting current-supply heating legs are bent twice in zigzag, FIG. 2 is a schematic view illustrating that the flat double emitter (double emitter type 3) in FIG. 1 is assembled to a base for an X-ray tube, and FIG. 3 is a diagram schematically illustrating the arrangement relation among an electron emission surface, current-supply heating legs, folding lines, each plane, and a center axis. The present embodiment describes a flat emitter (flat double emitter) configured such that two full-lighting current-supply heating legs are linearly formed and two half-lighting current-supply heating legs are bent twice in zigzag, for example. The flat double emitter configured such that two full-lighting current-supply heating legs are linearly formed and two half-lighting current-supply heating legs are bent twice in zigzag as illustrated in FIG. 1 will be referred to as a "double emitter type 3" below. FIG. 1A is a schematic perspective view of the double emitter type 3, FIG. 1B is a schematic front view viewed from front F in FIG. 1A, FIG. 1C is a schematic side view viewed from a side face S in FIG. 1A, and FIG. 1D is a schematic plan view viewed from a top surface U in FIG. 1A.

As illustrated in FIG. 1, the flat double emitter (double emitter type 3) according to the present embodiment includes four current-supply heating legs 2 to 5 at the base part of an electron emission surface 1. The legs 2 and 3 out of the legs 2 to 5 are full-lighting current-supply heating legs 2 and 3 used for full lighting for a large focus in which a current is supplied to heat the entire region of the electron emission surface to emit electrons. On the other hand, the legs 4 and 5 out of the legs 2 to 5 are half-lighting current-supply heating legs 4 and 5 used for half lighting for a small focus in which a current is supplied to heat only a region narrower than the entire region of the electron emission surface 1 to emit electrons.

When the entire region of the electron emission surface 1 is to be heated, a current is supplied from the full-lighting current-supply heating legs 2 and 3 to heat the entire surface. On the other hand, when the electron emission surface is locally lighted to restrict the electron emission range for reducing a focal spot, a current is supplied from the half-lighting current-supply heating legs 4 and 5 to light and heat only the region narrower than the entire region. In the full lighting, the current supply path becomes the full-lighting current-supply heating leg 2→the base part of the full-lighting current-supply heating leg 2→the base part of the half-lighting current-supply heating leg 5→the base part of the half-lighting current-supply heating leg 4→the base part of the full-lighting current-supply heating leg 3→the full-lighting current-supply heating leg 3. In the half lighting, the current supply path becomes the half-lighting current-supply heating leg 4→the base part of the half-lighting current-supply heating leg 4→the base part of the half-lighting current-supply heating leg 5→the half-lighting current-supply heating leg 5. In this way, the current supply path is changed to switch an electron emission region of the flat emitter (double emitter type 3).

Accordingly, the flat emitter (double emitter type 3) includes four current-supply heating legs 2 to 5, and is configured to be capable of selecting the half lighting for a small focus in which a current is supplied to heat only a region narrower than the entire region to emit electrons and the full lighting for a large focus in which a current is supplied to heat the entire region to emit electrons, according to the combination of the legs 2 to 5. As illustrated in FIG. 1A, all of the four current-supply heating legs 2 to 5 are folded at base parts at the electron emission portion (electron emission surface 1).

The power source for supplying a current is not particularly limited. The power source may be an AC power source or DC power source.

Figure 3C:
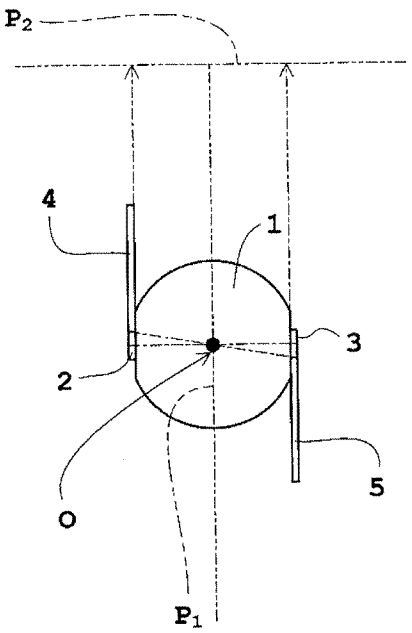
FIGS. 3A to 3C are each a diagram schematically illustrating the arrangement relation among an electron emission surface, current-supply heating legs, folding lines, each plane, and a center axis.
Figure 3B:
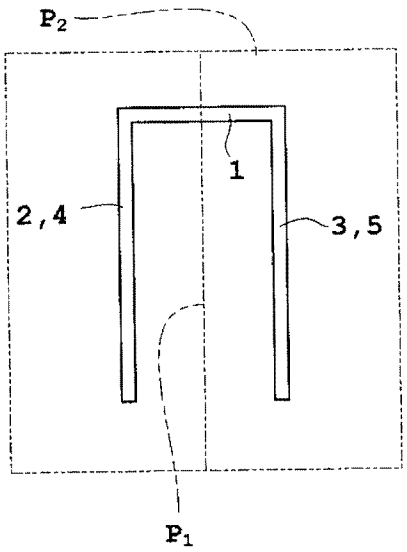
Figure 3A:
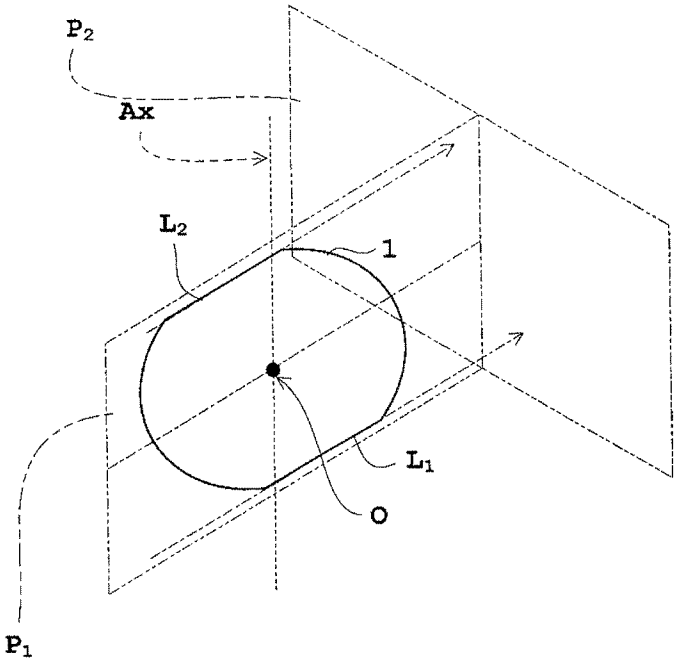

In the present embodiment, four current-supply heating legs 2 to 5 are folded at 90 degrees from their base parts as illustrated in FIG. 1A. The arrangement relation among the electron emission surface 1, the current-supply heating legs 2 to 5, each plane, and a center axis will be described with reference to FIG. 3. FIGS. 3A to 3C are schematic diagrams, and the current-supply heating legs 2 to 5 are not illustrated in some of FIGS. 3A to 3C. FIG. 3A is a perspective view schematically illustrating the arrangement relation among the electron emission surface, folding lines, each plane, and the center axis, FIG. 3B is a front view schematically illustrating the current-supply heating legs viewed from front in FIG. 3A, and FIG. 3C is a plan view schematically illustrating the current-supply heating legs viewed from a top surface in FIG. 3A.

As illustrated in FIG. 3A, the folding lines at the base part are defined as $L_1$ and $L_2$, and the center of the electron emission surface 1 is defined as O as illustrated in FIGS. 3A and 3C. The plane in the vertical direction of the electron emission surface 1 and in the direction parallel to the folding lines $L_1$ and $L_2$ at the base part, and passing through the center O of the electron emission surface 1 is defined as $P_1$ as illustrated in FIGS. 3A to 3C. The center axis, which is the vertical axis of the electron emission surface 1 and passes through the center O of the electron emission surface 1, is defined as Ax as illustrated in FIG. 3A. In addition, the plane formed by dropping the folding lines $L_1$ and $L_2$ at the base part as perpendicular lines is defined as $P_2$ as illustrated in FIGS. 3A to 3C.

In the present embodiment, the legs 2 to 5 are folded at 90 degrees at the folding lines $L_1$ and $L_2$ (see FIG. 3A) as illustrated in FIG. 1A. As illustrated in FIGS. 1A and 1D, the two full-lighting current-supply heating legs 2 and 3 are arranged to be symmetric about the plane $P_1$ (see FIGS. 3A to 3C) which is in the vertical direction of the electron emission surface 1 and in the direction parallel to the folding lines $L_1$ and $L_2$ at the base part and passes through the center O (see FIGS. 3A and 3C) of the electron emission surface 1. As illustrated in FIGS. 1A and 1D, the two half-lighting current-supply heating legs 4 and 5 are arranged to be symmetric about the center axis Ax (see FIG. 3A) which is the vertical axis of the electron emission surface 1 and passes through the center O of the electron emission surface 1. As described later, the two half-lighting current-supply heating legs 4 and 5 are bent twice in zigzag, so that the bending directions of the half-lighting current-supply heating legs 4 and 5 in zigzag are also symmetric about the center axis Ax. Further, the legs 2 to 5 are folded at 90 degrees, so that the two full-lighting current-supply heating legs 2 and 3 are opposite to each other, and the two half-lighting current-supply heating legs 4 and 5 are arranged to be parallel to each other.

In the present embodiment, the full-lighting current-supply heating legs 2 and 3 and the half-lighting current-supply heating legs 4 and 5 are equal in height in the vertical direction of the electron emission surface 1 as illustrated in FIGS. 1A to 1C. The height in the vertical direction is designed to be 6.6 mm. It is obvious that the height in the vertical direction is not limited to 6.6 mm.

In the present embodiment, when the flat emitter (double emitter type 3) is projected on the plane $P_2$ (see FIGS. 3A to 3C) formed by dropping the folding lines $L_1$ and $L_2$ at the base part as perpendicular lines as illustrated in FIG. 1B, the pair of the full-lighting current-supply heating leg 2 and the half-lighting current-supply heating leg 4 are folded at the folding line $L_2$, while the pair of the full-lighting current-supply heating leg 3 and the half-lighting current-supply heating leg 5 are folded at the folding line $L_1$. In this case, the pair of the full-lighting current-supply heating leg 2 and the half-lighting current-supply heating leg 4 folded at the bending line $L_2$ and the pair of the full-lighting current-supply heating leg 3 and the half-lighting current-supply heating leg 5 folded at the bending line $L_1$ are arranged to be overlapped with each other on the plane $P_2$ on which the flat emitter is projected. Since the four current-supply heating legs 2 to 5 are folded at 90 degrees at their base parts, the flat emitter looks as if it has a shape formed by rotating a reversed C shape at 90 degrees including the electron emission surface 1 as illustrated in FIG. 1B, when viewed (projected) from the front surface F in FIG. 1A.

In the present embodiment, the two full-lighting current-supply heating legs 2 and 3 are linearly formed, and the two half-lighting current-supply heating legs 4 and 5 are bent twice in zigzag as illustrated in FIGS. 1A, 1C, and 1D. Specifically, the two half-lighting current-supply heating legs 4 and 5 are bent at right angle (90 degrees) and further bent at right angle (90 degrees) in zigzag. The half-lighting current-supply heating legs 4 and 5 are bent twice in zigzag as described above, whereby the directions in which the full-lighting current-supply heating legs 2 and 3 and the half-lighting current-supply heating legs 4 and 5 extend can be aligned parallel to each other at their terminals. The full-lighting current-supply heating legs 2 and 3 are linearly formed, and the half-lighting current-supply heating legs 4 and 5 are bent twice in zigzag, whereby the space between the full-lighting current-supply heating leg and the half-lighting current-supply heating leg, which are adjacent to each other, at their terminals are larger than the space at their base parts.

In the double emitter type 3 thus produced, the space (the distance between the center axes of the legs) between the full-lighting current-supply heating leg and the half-lighting current-supply heating leg which are adjacent to each other is 3.5 mm. The diameter of the electron emission surface 1 is 5 mm, and the thickness thereof is 0.1 mm±0.01 mm. The legs 2 to 5 are designed to have the vertical height of 6.6 mm as described above. Similar to the height in the vertical direction, these sizes (the distance between the center axes of the legs, and the diameter and thickness of the electron emission surface 1) are not limited to the above specific numerical values.

When the double emitter type 3 is assembled to an X-ray tube, the terminals of the four current-supply heating legs 2 to 5 are fixed to electrode bars ER (base), which are brazed to an insulating member I, with welding or brazing. The space (the distance between the center axes of the legs) between the full-lighting current-supply heating leg and the half-lighting current-supply heating leg which are adjacent to each other is set as 3.5 mm. With this configuration, each of the electrode bars ER having a diameter ϕ1.24 mm, which is sufficient in strength, can be fixed to the insulating member I such as a ceramic with brazing or welding without any troubles, while providing electrical insulation between them. The full-lighting current-supply heating legs 2 and 3 and the half-lighting current-supply heating legs 4 and 5 are equal in height in the vertical direction of the electron emission surface 1, whereby the electrode bars ER have the same height from the base.

When the flat double emitter (double emitter type 3) according to the present embodiment is actually fixed to the base in order from the full-lighting current-supply heating leg, one of the half-lighting current-supply heating legs, and the other half-lighting current-supply heating leg, it is confirmed that the yield by which the almost flat electron emission surface 1 (an irregularity of the electron emission surface 1 is about ±0.01 mm relative to the thickness of 0.1 mm) is obtained is about 70% (six out of nine). It is also confirmed that a predetermined 0.5 mm focal spot specification (focal spot width: 0.5 mm to 0.75 mm) is attained in a small focal spot mode (tube voltage: 75 kV, tube current: 300 mA) of a tube bulb of an X-ray tube to which the flat double emitter (double emitter type 3) fixed to the base is mounted.

The flat emitter (double emitter type 3) according to the present embodiment includes four current-supply heating legs 2 to 5, wherein one of a set of two full-lighting current-supply heating legs 2 and 3 for full lighting and a set of the two half-lighting current-supply heating legs 4 and 5 for half lighting is linearly formed, and the other is bent plural times in zigzag. In FIG. 1, the two full-lighting current-supply heating legs 2 and 3 are linearly formed, and the two half-lighting current-supply heating legs 4 and 5 are bent twice in zigzag. With this configuration, the space between the full-lighting current-supply heating leg and the half-lighting current-supply heating leg, which are adjacent to each other, at their terminals can be set larger than the space at their base parts. Since the space between the legs at their terminals is increased, the distance between the electrode bars ER for fixing the legs is also increased, whereby the electrical insulation between the electrode bars is easily provided. Either one of the sets of the legs (the full-lighting current-supply heating legs 2 and 3 in FIG. 1) is linearly formed, whereby balance is easily kept. Consequently, the emitter can easily be assembled to an electron source for an X-ray tube or to an electron source for another use with high precision.

One of the set of the two full-lighting current-supply heating legs 2 and 3 and the set of the two half-lighting current-supply heating legs 4 and 5 may be linearly formed, and the other may be bent plural times in zigzag. However, it is preferable that the two full-lighting current-supply heating legs 2 and 3 are linearly formed, and the two half-lighting current-supply heating legs 4 and 5 are bent plural times (twice in FIG. 1) in zigzag as in the present embodiment. When a current is supplied for heating, a temperature gradient occurs on the electron emission portion (electron emission surface 1). Specifically, heat is released more through the electrode bar at the base part of the electron emission portion (electron emission surface 1) close to the current supply source. Therefore, the temperature at the base part is lower than the central part apart from the current supply source. Especially in the full lighting, a current is supplied only from the full-lighting current-supply heating legs 2 and 3, and the current supply path becomes the upstream full-lighting current-supply heating leg 2→the base part of the upstream full-lighting current-supply heating leg 2→the base part of the upstream half-lighting current-supply heating leg 5→the base part of the downstream half-lighting current-supply heating leg 4→the base part of the downstream full-lighting current-supply heating leg 3→the downstream full-lighting current-supply heating leg 3. With this, heat is released from the base part of each leg, which results in a significant temperature gradient. Heat is more easily released from the short leg. When the two full-lighting current-supply heating legs 2 and 3 are linearly formed, heat is easily released from the base parts of the full-lighting current-supply heating legs 2 and 3 on the electron emission portion (electron emission surface 1), while heat is difficult to be released from the base parts of the long half-lighting current-supply heating legs 4 and 5. Accordingly, the temperature distribution can be made almost uniform.

In the case where the two full-lighting current-supply heating legs 2 and 3 are linearly formed and the two half-lighting current-supply heating legs 4 and 5 are bent plural times (twice in FIG. 1) in zigzag as in the present embodiment, it is preferable that the two linearly-formed full-lighting current-supply heating legs 2 and 3 are arranged to be symmetric about the plane $P_1$ which is in the vertical direction of the electron emission surface 1 and in the direction parallel to the folding lines $L_1$ and $L_2$ at the base part and passes through the center O of the electron emission surface 1. With the arrangement of the two linearly-formed full-lighting current-supply heating legs 2 and 3 as described above, the two full-lighting current-supply heating legs 2 and 3 are completely overlapped with each other when the full-lighting current-supply heating legs 2 and 3 are projected from the side face S in FIG. 1A as illustrated in FIG. 1C. Accordingly, the balance of the entire flat emitter can easily be kept when the legs are fixed to the base used for assembling the emitter to an electron source for an X-ray tube or an electron source for another use, whereby the deformation of the electron emission surface 1 is difficult to occur. Specifically, the deformation of the electron emission surface caused by the circumferential deviation of the electron emission surface 1 with the vertical axis of the electron emission surface 1 being defined as a rotation center is difficult to occur, resulting in that the electron emission surface 1 can be fixed almost horizontally. In this way, the legs can be fixed with high precision based on the full-lighting current-supply heating legs 2 and 3.

In the case where the two full-lighting current-supply heating legs 2 and 3 are linearly formed and the two half-lighting current-supply heating legs 4 and 5 are bent plural times (twice in FIG. 1) in zigzag as in the present embodiment, it is preferable that the two half-lighting current-supply heating legs 4 and 5, which are bent plural times (twice in FIG. 1) in zigzag, are arranged to be symmetric about the center axis Ax which is the vertical axis of the electron emission surface 1 and passes through the center O of the electron emission surface 1. This configuration makes it easy to match the center of a base, which is used to assemble the emitter to an electron source for an X-ray tube or an electron source for another use, and the center of the electron emission surface 1 of the flat emitter. Accordingly, the flat emitter (double emitter type 3) can be arranged with high precision relative to the focusing electrode in an electron source for an X-ray tube or an electron source for another use.

In the flat emitter (double emitter type 3) according to the present embodiment, the full-lighting current-supply heating legs 2 and 3 and the half-lighting current-supply heating legs 4 and 5 are preferably equal in height in the vertical direction of the electron emission surface 1. With this configuration, the height of the electrode bars ER on the base for fixing the legs 2 to 5 becomes the same, whereby the electron emission surface 1 can be horizontally fixed.

In the flat emitter (double emitter type 3) according to the present embodiment, it is preferable that, when the flat emitter (double emitter type 3) is projected on the plane $P_2$ formed by dropping the folding lines $L_1$ and $L_2$ at the base part as perpendicular lines, the pair of the full-lighting current-supply heating leg and the half-lighting current-supply heating leg, which are folded at the same folding line $L_1$ (or $L_2$), is arranged such that they are overlapped with each other on the plane $P_2$ on which the emitter is projected. With the configuration in which the pair of the full-lighting current-supply heating leg and the half-lighting current-supply heating leg, which are folded at the same folding line $L_1$ (or $L_2$), is arranged such that they are overlapped with each other on the plane $P_2$ on which the emitter is projected, the full-lighting current-supply heating leg and the half-lighting current-supply heating leg, which make a pair and are folded at the same folding line $L_1$ (or $L_2$), are completely overlapped with each other as viewed (projected) from the front surface F in FIG. 1A as illustrated in FIG. 1B, because they are folded at the same folding line $L_1$ (or $L_2$) at the base part. According to this, the strength can be increased upon fixing the legs 2 to 5 to the base used for assembling the emitter to an electron source for an X-ray tube or an electron source for another use. Thus, the legs 2 to 5 can stably be fixed to the base.

The present invention is not limited to the above embodiment, and can be modified as described below.

(1) The flat emitter according to the present invention is used for an electron source for an X-ray tube or an electron source for another use, and an electron source to which the flat emitter is applied is not particularly limited. For example, the flat emitter can be applied to a rotating envelope medical X-ray tube in which an anode rotates with an envelope storing the anode, other medical X-ray tubes, an industrial large-focus X-ray tube, or an electron source with a feature of a large focus.

(2) In the above embodiment, the flat emitter has the circular electron emission surface 1. However, the present invention is applicable to a flat emitter having a rectangular electron emission surface as illustrated in FIG. 2 in Patent Document 1. As described above, the shape of the electron emission surface is not particularly limited.

(3) In the above embodiment, four current-supply heating legs 2 to 5 are folded at 90 degrees from their base parts. However, the folding angle is not limited to 90 degrees. The legs may be folded at an acute angle or an obtuse angle other than 90 degrees. However, the legs 2 to 5 is most preferably folded at 90 degrees from their base parts as in the embodiment for enhancing strength upon fixing the legs 2 to 5 to the base.

Figure 4:
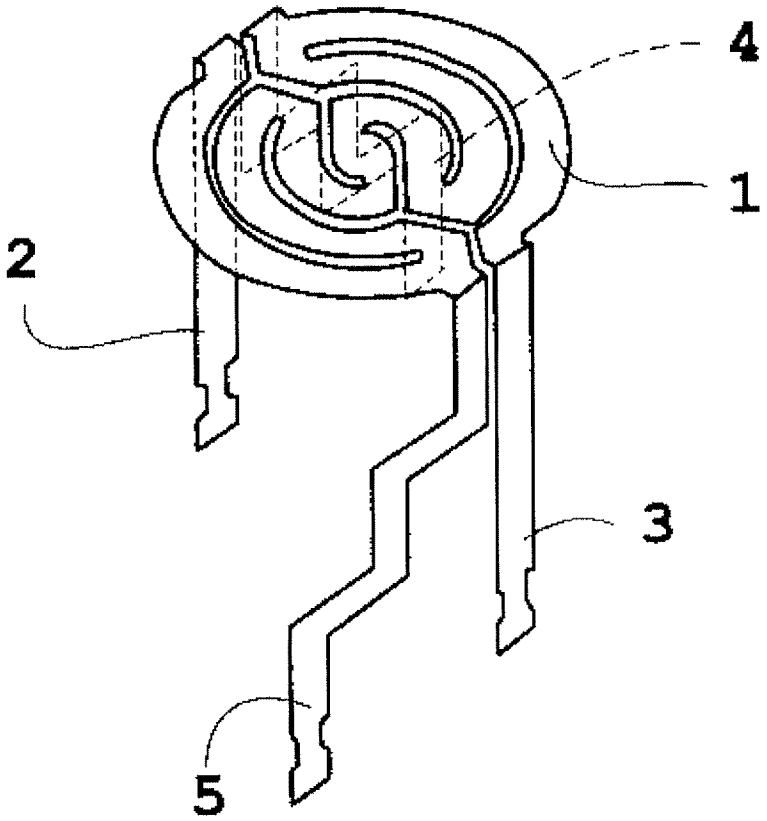
FIG. 4 is a schematic perspective view illustrating a flat double emitter according to a modification in which half-lighting current-supply heating legs are bent four times in zigzag.

(4) In the above embodiment, the half-lighting current-supply heating legs 4 and 5 are bent twice in zigzag, that is, the half-lighting current-supply heating legs 4 and 5 are bent at right angle (90 degrees), and then, further bent at right angle (90 degrees). However, the number of bending the legs in zigzag is not limited to two as in FIG. 1. The number may be two or more. For example, the half-lighting current-supply heating legs 4 and 5 may be bent four times in zigzag as illustrated in FIG. 4. In addition, the number of bending the legs in zigzag is not necessarily limited to an even number in order to align the directions in which the legs 2 to 5 extend at their terminals. For example, the half-lighting current-supply heating legs 4 and 5 may be bent three times in zigzag, that is, they may be bent at 135 degrees, then, bent at 135 degrees to the same side, and then, bent at right angle (90 degrees) to the opposite side in zigzag. Even when the legs are bent odd number of times in zigzag, the directions in which the legs 2 to 5 extend can be aligned to be parallel at their terminals.

Figure 5:
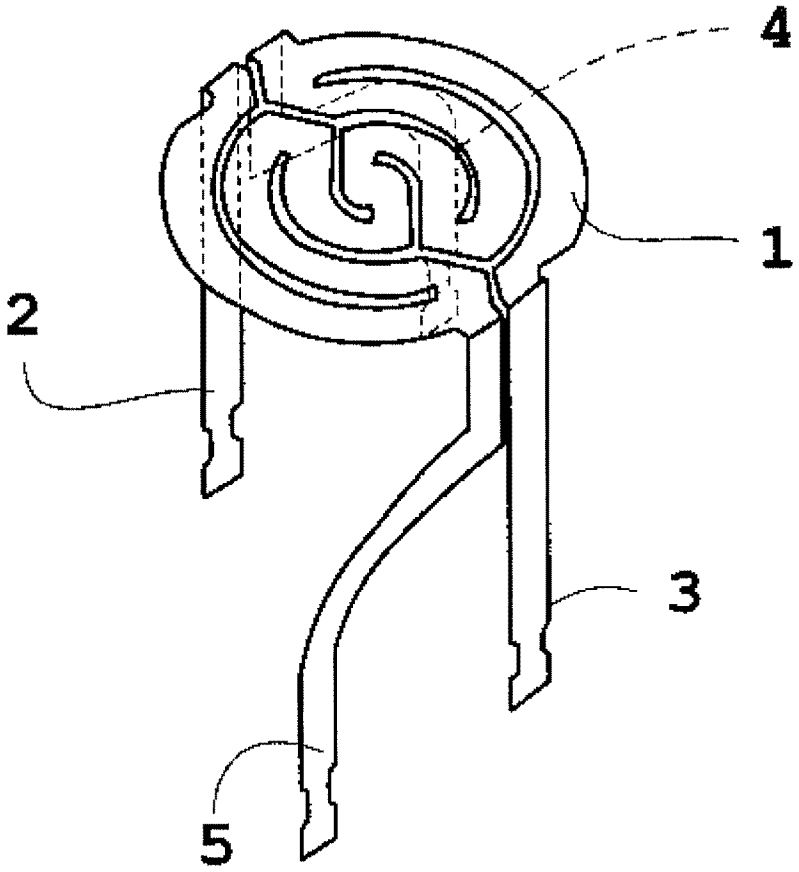
FIG. 5 is a schematic perspective view illustrating a flat double emitter according to a modification in which half-lighting current-supply heating legs are bent in zigzag in a curved line.

(5) In the above embodiment, the half-lighting current-supply heating legs 4 and 5 are bent in zigzag in a straight line, that is, they are bent at right angle (90 degrees), and then, bent at right angle (90 degrees) in zigzag. However, the zigzag shape is not limited to be linear. For example, the half-lighting current-supply heating legs 4 and 5 may be bent in zigzag in a curved line as illustrated in FIG. 5.

Figure 6:
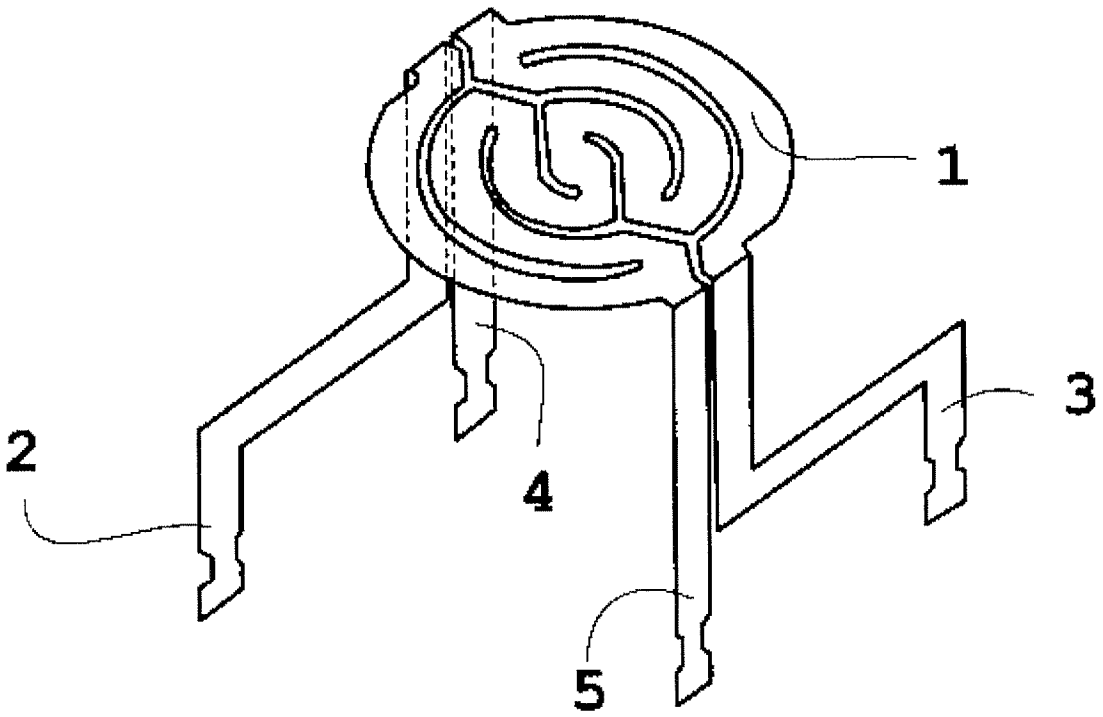
FIG. 6 is a schematic perspective view illustrating a flat double emitter according to a modification in which full-lighting current-supply heating legs are bent twice in zigzag.
Figure 7:
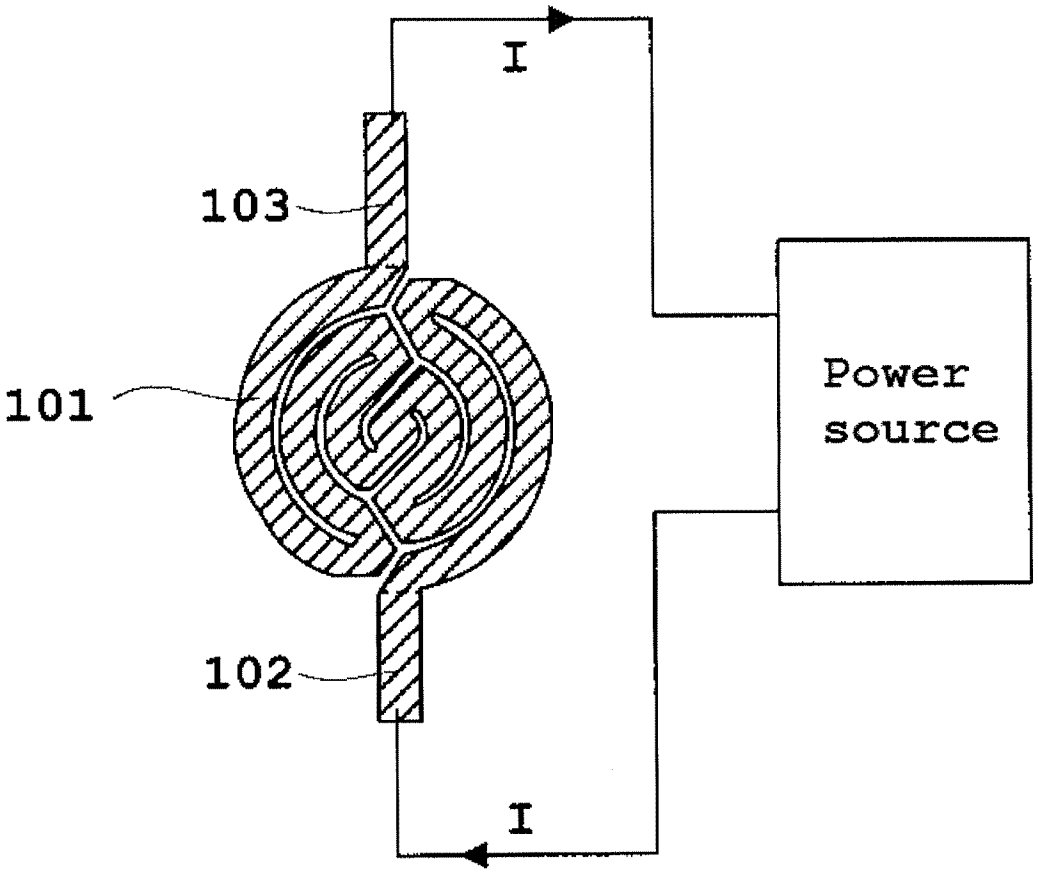
FIG. 7 is a schematic plan view illustrating a conventional flat emitter.
Figure 8B:
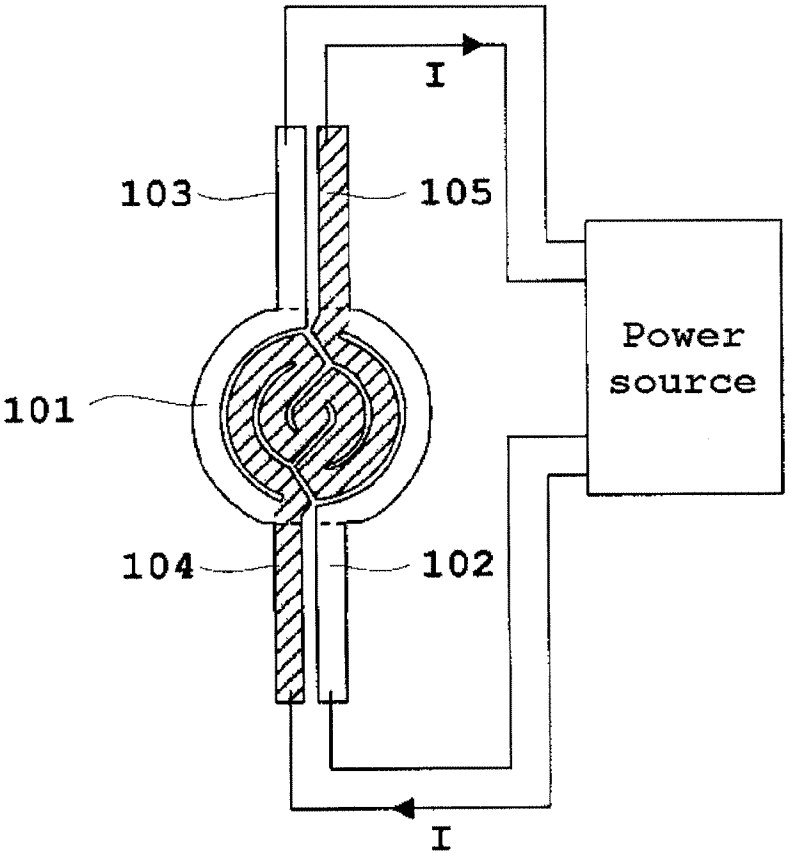
FIGS. 8A and 8B are each a schematic plan view illustrating a conventional flat double emitter.
Figure 8A:
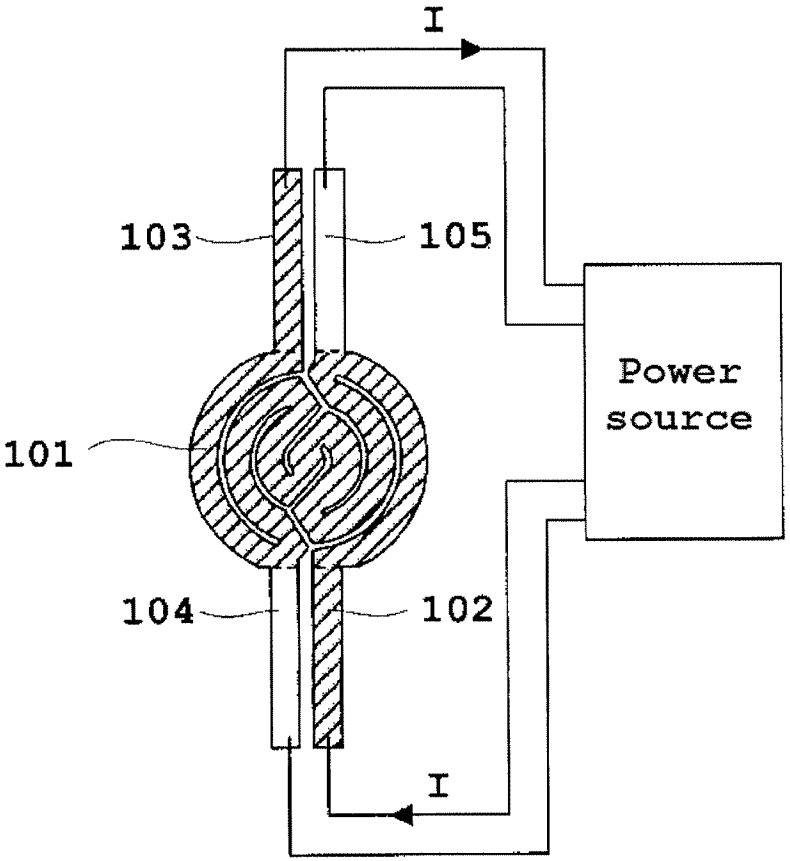
Figure 9:
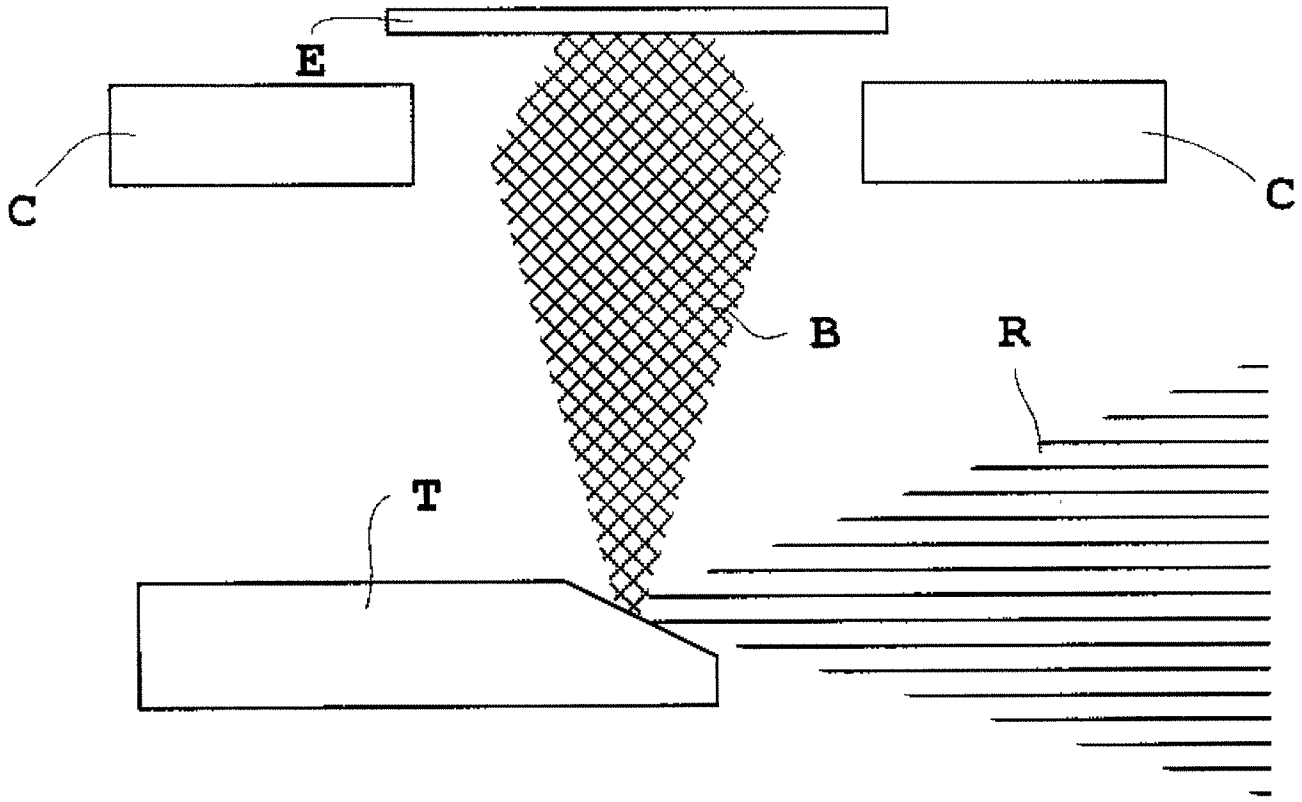
FIG. 9 is a diagram schematically illustrating an arrangement relation between a focusing electrode and an emitter.
Figure 10A:
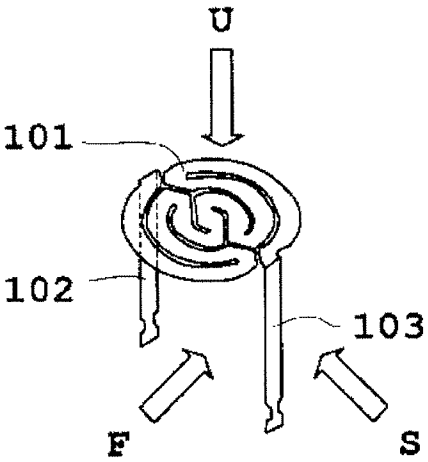
FIGS. 10A to 10D are each a schematic diagram illustrating a conventional flat emitter in which current-supply heating legs in FIG. 7 are folded at 90 degrees from their base parts.
Figure 10B:
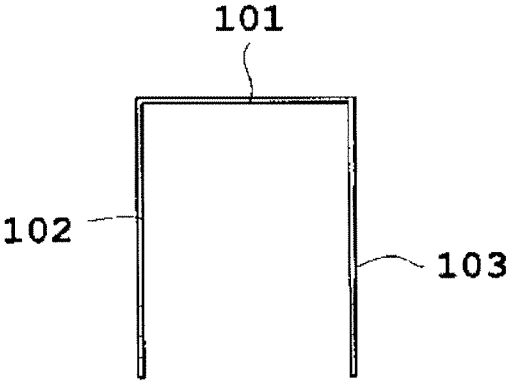
Figure 10C:
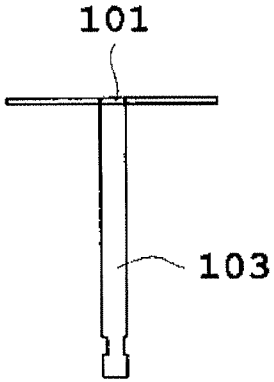
Figure 10D:
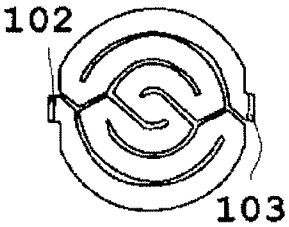
Figure 11:
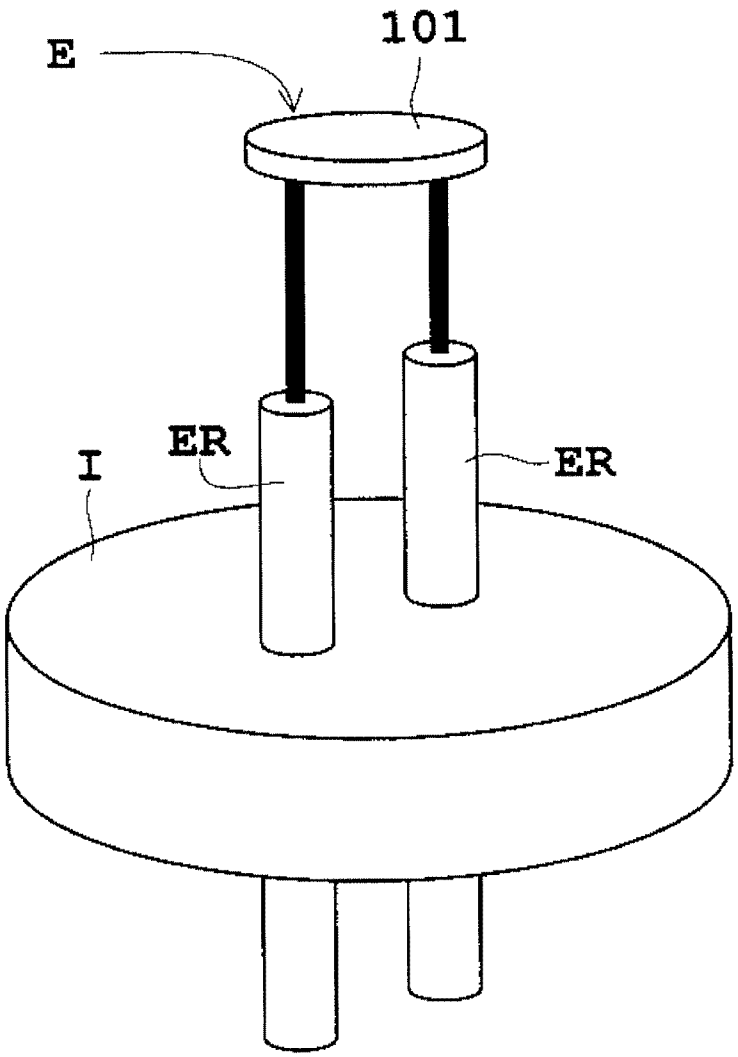
FIG. 11 is a schematic diagram illustrating that the conventional flat emitter in FIG. 10 is assembled to a base for an X-ray tube.
Figure 12A:
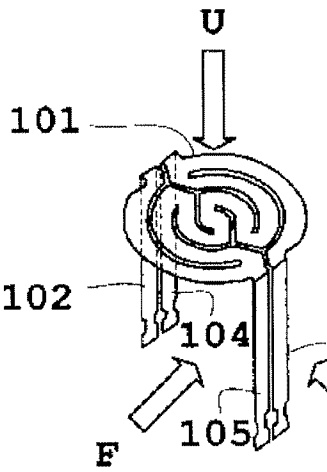
FIGS. 12A to 12D are each a schematic diagram illustrating a flat double emitter (double emitter type 1) in which the current-supply heating legs in FIG. 8 are folded at 90 degrees from their base parts.
Figure 12B:
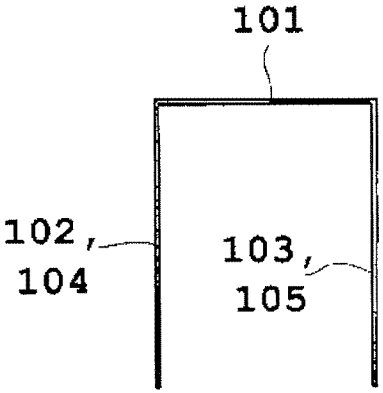
Figure 12C:
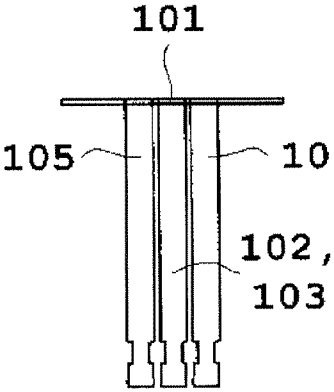
Figure 12D:
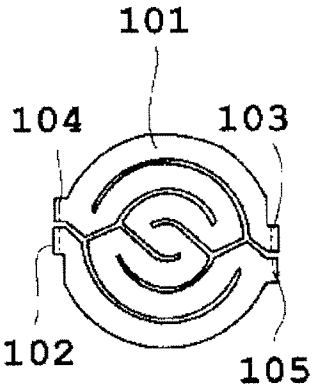
Figure 13B:
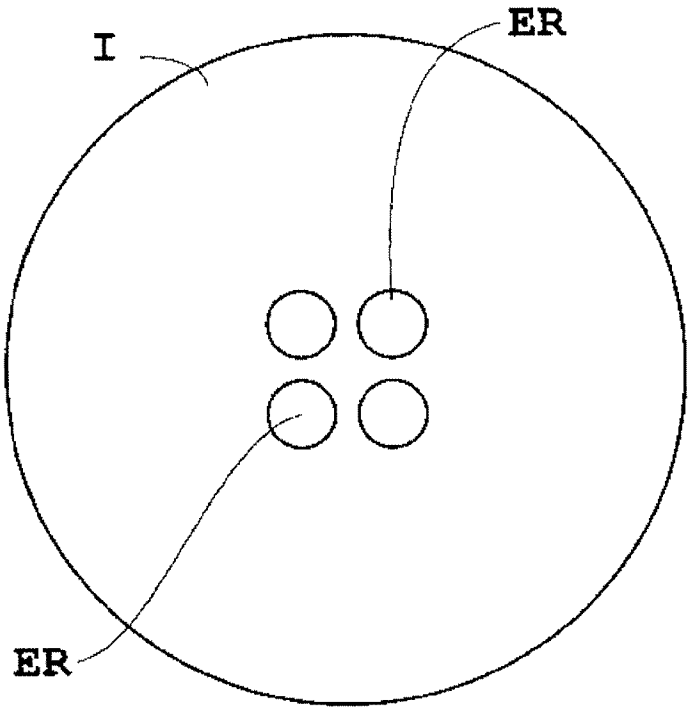
FIGS. 13A and 13B are each a schematic diagram illustrating that the flat double emitter (double emitter type 1) in FIG. 12 is assembled to a base for an X-ray tube.
Figure 13A:
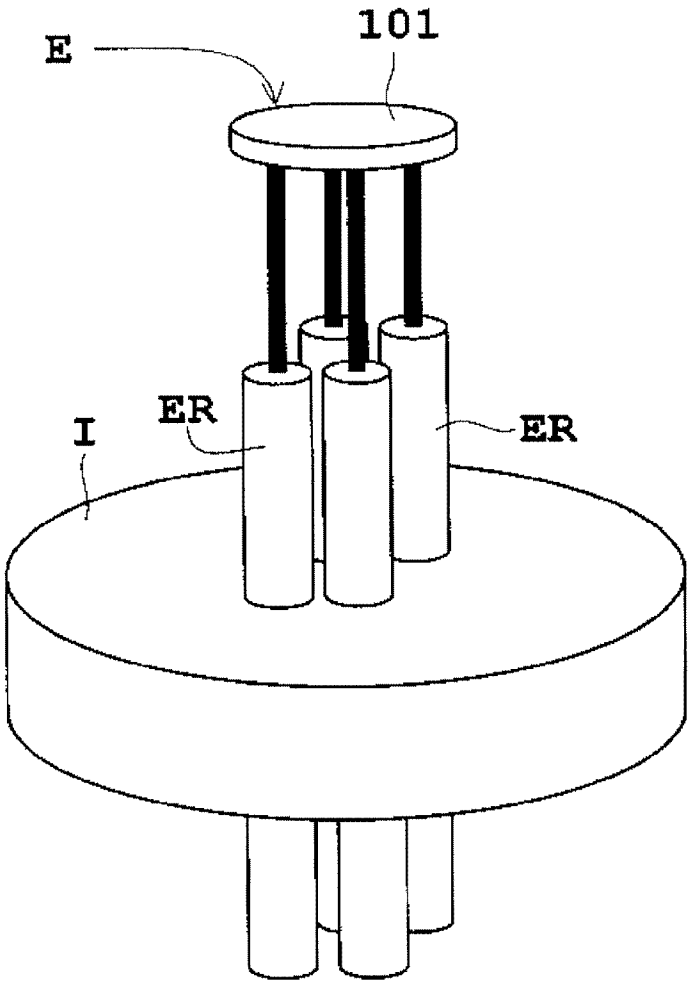
Figure 14A:
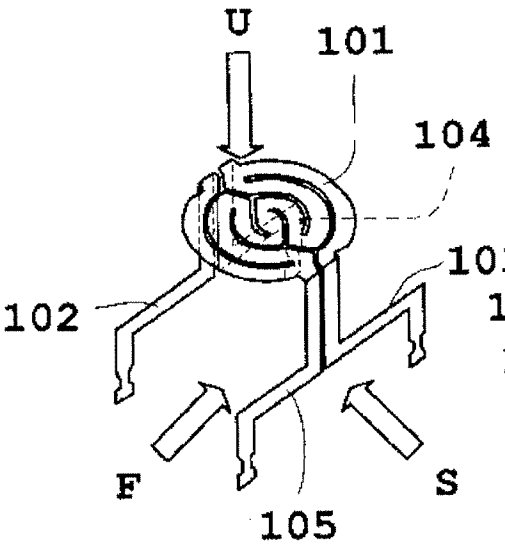
FIGS. 14A to 14D are each a schematic diagram illustrating a flat double emitter (double emitter type 2) in which all current-supply heating legs are bent plural times in zigzag.
Figure 14B:
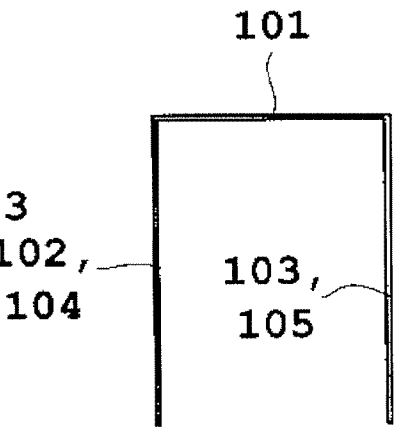
Figure 14C:
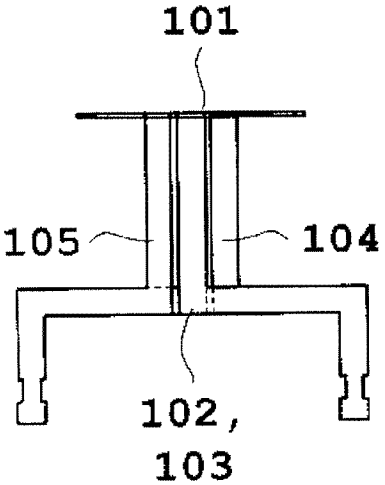
Figure 14D:
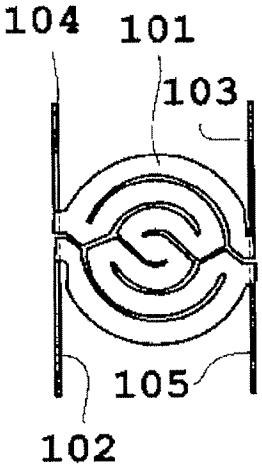
Figure 15:
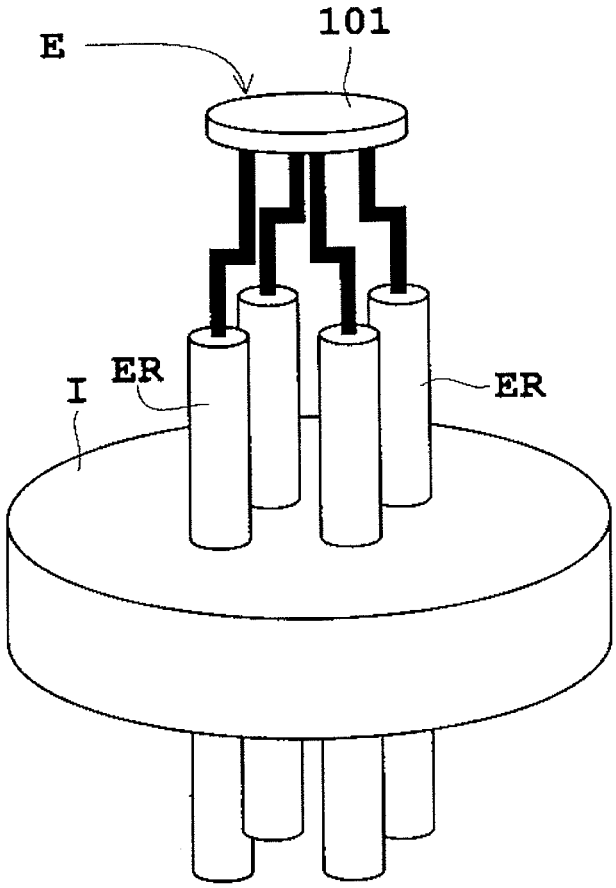
FIG. 15 is a schematic diagram illustrating that the flat double emitter (double emitter type 2) in FIG. 14 is assembled to a base for an X-ray tube.

(6) In the above embodiment, the two full-lighting current-supply heating legs 2 and 3 are linearly formed, and the two half-lighting current-supply heating legs 4 and 5 are bent plural times (twice in FIG. 1) in zigzag. However, the emitter may be configured as illustrated in FIG. 6, so long as one of the set of the two full-lighting current-supply heating legs and the set of the half-lighting current-supply heating legs is linearly formed, and the other is bent plural times in zigzag. Notably, the structure in the embodiment is preferable, since the structure according to the embodiment (see FIG. 1) can make the temperature distribution almost uniform. If the temperature distribution is already uniform, or the temperature gradient is not considered, the two half-lighting current-supply heating legs 4 and 5 may be linearly formed, and the two full-lighting current-supply heating legs may be bent plural times (twice in FIG. 6) in zigzag as illustrated in FIG. 6. In the case where the two half-lighting current-supply heating legs 4 and 5 are linearly formed, and the two full-lighting current-supply heating legs are bent plural times (twice in FIG. 6) in zigzag, the above modifications (1) to (5) can also be applied.

(7) In the above embodiment, the two full-lighting current-supply heating legs 2 and 3 are disposed to be symmetric about the plane $P_1$ which is in the vertical direction of the electron emission surface 1, in the direction parallel to the folding lines $L_1$ and $L_2$ at the base part, and passes through the center O of the electron emission surface 1. However, these legs are not necessarily disposed to be symmetric about a plane. If deformation of the electron emission surface caused by the circumferential deviation of the electron emission surface 1 about the vertical axis of the electron emission surface 1 serving as a rotation center is not considered, the two full-lighting current-supply heating legs 2 and 3 may be disposed to be asymmetric.

(8) In the above embodiment, the two half-lighting current-supply heating legs 4 and 5 are disposed to be symmetric about the center axis Ax that is the vertical axis of the electron emission surface 1 and passes through the center O of the electron emission surface 1. However, these legs are not necessarily disposed to be symmetric about an axis. If deformation of the electron emission surface caused by the circumferential deviation of the electron emission surface 1 about the vertical axis of the electron emission surface 1 serving as a rotation center is not considered, the two half-lighting current-supply heating legs 4 and 5 may be disposed to be asymmetric.

(9) In the above embodiment, the full-lighting current-supply heating legs 2 and 3 and the half-lighting current-supply heating legs 4 and 5 have the same height in the vertical direction of the electron emission surface 1. However, these legs do not have to have the same height. When the electrode bars ER on the base on which the legs 2 to 5 are fixed have different height, the height of each of the legs 2 to 5 may be changed according to the height of each electrode bar ER on the base in order that the electron emission surface 1 is fixed on a horizontal plane.

(10) In the above embodiment, the pair of the full-lighting current-supply heating leg and the half-lighting current-supply heating leg folded on the same folding line $L_1$ (or $L_2$) is disposed such that they are overlapped with each other on the plane $P_2$ on which the flat emitter is projected, when the flat emitter is projected on the plane $P_2$ formed by dropping the folding lines $L_1$ and $L_2$ at the base part as perpendicular lines. However, they are not necessarily disposed to be overlapped with each other. The pair of the full-lighting current-supply heating leg and the half-lighting current-supply heating leg folded on the same folding line $L_1$ (or $L_2$) may be shifted from each other.

As described above, the present invention is suitable for a rotating envelope medical X-ray tube in which an anode rotates with an envelope storing the anode, other medical X-ray tubes, an industrial large-focus X-ray tube, or an electron source with a feature of a large focus.

What is claimed is:

1. A flat emitter used for an electron source, the flat emitter comprising:

four current-supply heating legs; wherein half lighting for a small focus in which a current is supplied to heat only a region narrower than an entire region to emit electrons and full lighting for a large focus in which a current is supplied to heat the entire region to emit electrons are selectable according to the combination of the legs, all of the four current-supply heating legs are folded at a base part of an electron emission portion, and either one of a set of the two full-lighting current-supply heating legs for the full lighting and a set of the two half-lighting current-supply heating legs for the half lighting is linearly formed, and the other is formed to be bent plural times in zigzag to set the space between the full-lighting current-supply heating leg and the half-lighting current-supply heating leg, which are adjacent to each other, at their terminals to be larger than the space at their base parts.

2. The flat emitter according to claim 1, wherein the two full-lighting current-supply heating legs are linearly formed, and the two half-lighting current-supply heating legs are bent plural times in zigzag.

3. The flat emitter according to claim 1, wherein the two full-lighting current-supply heating legs or the two half-lighting current-supply heating legs linearly formed are disposed to be symmetric with each other about a plane which is in the vertical direction of an electron emission surface, in the direction parallel to a folding line at the base part, and passes through the center of the electron emission surface.

4. The flat emitter according to claim 1, wherein the two half-lighting current-supply heating legs or the two full-lighting current-supply heating legs bent plural times in zigzag are disposed to be symmetric with each other about a center axis that is a vertical axis of an electron emission surface and passes through the center of the electron emission surface.

5. The flat emitter according to claim 1, wherein the full-lighting current-supply heating legs and the half lighting current-supply heating legs have the same height in the direction vertical to an electron emission surface.

6. The flat emitter according to claim 1, wherein, when the flat emitter is projected on a plane formed by dropping folding lines at the base part as perpendicular lines, the pair of the full-lighting current-supply heating leg and the half-lighting current-supply heating leg folded at the same folding line is disposed to be overlapped with each other on the plane on which the flat emitter is projected.

* * * * *